United States Patent [19]

Tipple et al.

[11] Patent Number: 4,958,758

[45] Date of Patent: Sep. 25, 1990

[54] MULTI-LOOPED CANE RETAINING STRAP

[76] Inventors: Jerome E. Tipple; Margie K. Tipple, both of Rte. #1, Box 212, Lagro, Ind. 46941

[21] Appl. No.: 341,280

[22] Filed: Apr. 19, 1989

Related U.S. Application Data

[63] Continuation of Ser. No. 109,404, Oct. 19, 1987, abandoned.

[51] Int. Cl.[5] ..... A45F 5/00

[52] U.S. Cl. ..... 224/267; 224/220; 224/221; 24/265 BC; 24/306; 24/3 A

[58] Field of Search ..... 224/217–222, 224/901, 267, 197, 200; 24/3 A, 265 BC, 265 H, 265 EC, 265 R, 306, 442; 135/65, 66, 21

[56] References Cited

U.S. PATENT DOCUMENTS

| | | | |
|---|---|---|---|
| 452,830 | 5/1891 | Bowie et al. | 224/220 |
| 534,946 | 2/1895 | Bates | 224/220 |
| 975,430 | 2/1910 | Humma et al. . | |
| 1,209,017 | 12/1916 | Pearson | 24/265 R |
| 1,593,162 | 2/1924 | Diehl et al. . | |
| 1,572,289 | 2/1926 | Hogan | 224/220 |
| 1,643,106 | 9/1927 | Williams | 224/220 X |
| 1,724,069 | 8/1929 | Butera | 224/222 |
| 2,499,882 | 9/1948 | Daniels | 224/222 |
| 3,433,495 | 3/1969 | Christensen . | |
| 3,854,640 | 12/1974 | Willmarth | 224/250 |
| 4,041,562 | 8/1977 | Nealy | 24/3 A X |
| 4,111,444 | 9/1978 | Clements, Jr. . | |
| 4,159,792 | 7/1979 | Siegal . | |
| 4,315,641 | 2/1982 | Larsen . | |
| 4,322,077 | 3/1982 | Van't Hof | 224/219 X |
| 4,489,867 | 12/1984 | Schwemberger . | |
| 4,520,533 | 6/1985 | Kasai | 24/265 BC |
| 4,728,123 | 3/1988 | Kassal et al. | 224/220 X |

FOREIGN PATENT DOCUMENTS

| | | | |
|---|---|---|---|
| 23401 | of 1893 | United Kingdom | 224/219 |
| 24107 | of 1895 | United Kingdom | 224/220 |
| 160400 | 3/1921 | United Kingdom | 224/220 |

*Primary Examiner*—Linda J. Sholl

*Attorney, Agent, or Firm*—Marshall & Melhorn

[57] ABSTRACT

A multi-looped cane retaining strap arranged to be releasably connected to a cane user's wrist and a cane, includes a wrist portion and a flexible cord attached to one another by a swivel device. The wrist portion includes a molded body with a transverse slot formed at one end and a soft flexible strip of material attached at the other end. The flexible material is inserted through the transverse slot and fastened by a loop-and-pile fastener to the user's wrist. The flexible cord is adjustable in length and size of the loop for retaining the cane. The multi-looped cane retaining strap provides for the cane to be in close proximity to the user in order to alleviate the inconveniences associated with cane use.

11 Claims, 1 Drawing Sheet

MULTI-LOOPED CANE RETAINING STRAP

This is a continuation of application Ser. No. 109404, filed Oct. 19, 1987, now abandoned.

BACKGROUND OF THE INVENTION

The present invention relates generally to a releasable object retaining strap, and more particularly to a releasable cane retaining strap device which can be used for attaching a cane to the user.

In the prior art, wrist strap devices have been used typically, for the retention of ski poles, tennis rackets, gloves, umbrellas, and other small items. These devices where designed to retain the item in close proximity to the user so as to allow for immediate use.

U.S. Pat. No. 4,315,614 discloses a multi-looped ski-pole strap which can be releasably disconnected from the pole and/or the skier's wrist. The strap comprises an elongated, flexible, soft strip of material having first and second ends connected by an elastic band member. Each end can be formed into a small loop and is provided with a Velcro material fastening means. One end is looped about the skier's wrist and the other end is looped about the body of the ski pole.

U.S. Pat. No. 4,159,792 discloses a tether or leash for gloves, such as ski gloves, which maintains the glove attached to the user's wrist or wrist encircling garment. The leash includes a length of elastic cord with an eyelet formed at each end. One of the ends passes through the eyelet at the opposite end to present a loop or band portion encircling the wrist area of the wearer. The loop or band portion is adjusted by knotting the cord between the ends.

U.S. Pat. No. 4,489,867 discloses a band worn on the user's arm or wrist having a short strap which carries a small item for occasional use such as a key. The strap has a captive end which is connected to the band, and a free end which retains the small item. The strap extends from the band in an access position, and is sufficiently long to permit the user to manipulate the small item using the thumb and forefingers on the same arm as the band. The band and the free end of the strap have selectively positioned loop-and-pile fasteners thereon for releasably securing the strap around the band in a concentric storage position, and for retention on the user's wrist.

It is an object of the present invention to permit the user of a cane the convenience of maintaining the cane in close proximity for use, and to alleviate the inauspicious difficulties associated with a cane while performing everyday functions. The present invention allows the cane user to perform everyday tasks such as unlocking and opening a door while one arm is full, or writing a check at a market or drug store without dropping the cane, having to lean it against something, or lie it on the counter. The present invention prevents the cane from ending up in a position where it is either in the way or isn't readily available for use.

SUMMARY OF THE INVENTION

The present invention relates to a cane retaining strap which is used to maintain a cane in close proximity to the cane user for convenience of use and to eliminate the displacement of the cane which occurs when the cane is dropped, set down, or leaned against something.

The present invention comprises a wrist strap and a flexible cord attached to the wrist strap by means of a swivel. The wrist strap includes a molded plastic body portion which is connected to a flexible soft strip of material. The molded body portion is configured with a slot at one end, and the soft flexible strip of material is attached at the opposite end. The molded body portion is further configured with the swivel attached through a central portion of the molded plastic body. The swivel is also attached to one end of the flexible cord which is used to retain the cane.

A releasable loop can be formed in the wrist strap by pulling the soft flexible material through the slot of the molded body portion. The soft strip of material of the wrist strap is provided with releasable fastening means such as Velcro fasteners, which are used to secure the loop around the user's wrist at the required size.

The other end of the flexible cord has a pair of fasteners attached thereto, one of which determines the length of the cord, and the other of which determines the size of a loop formed in the cord for retaining a cane.

The combination of the wrist strap, the flexible cord and the swivel form a multi-looped cane retaining strap providing the desired objectives of the present invention. The multi-looped cane retaining strap provides the cane user with a device which keeps the cane in proximity for immediate use, and eliminates the difficulties encountered when performing everyday tasks.

BRIEF DESCRIPTION OF THE DRAWINGS

The above objects and advantages of the invention will become manifest to one skilled in the art from considering the following detailed description of an embodiment of the invention in light of the accompanying drawings in which.

DESCRIPTION OF THE PREFERRED EMBODIMENT

Figure 1:
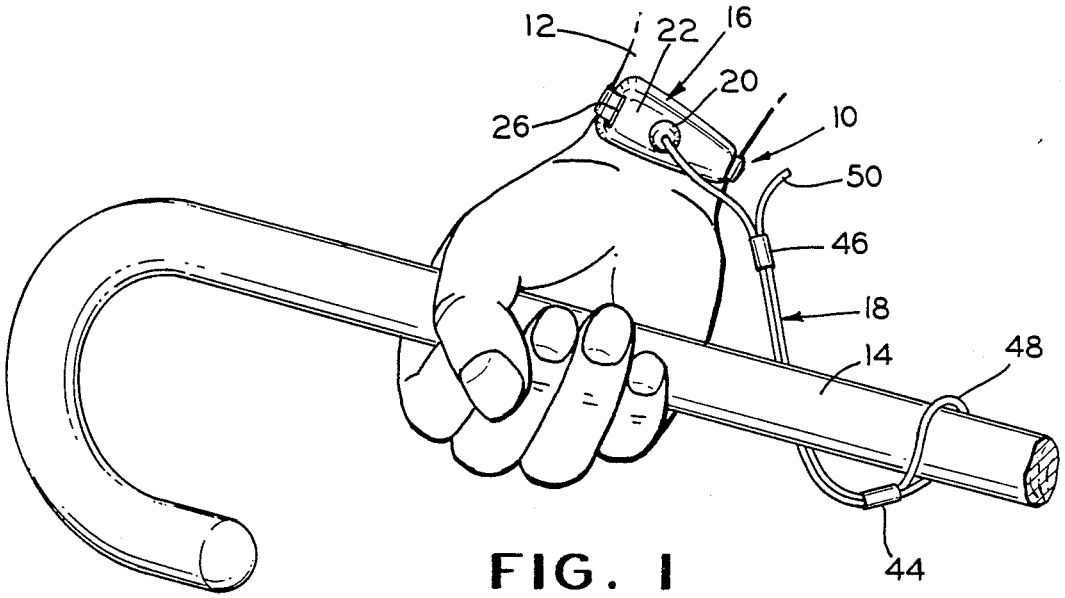
FIG. 1 is a perspective view of the present invention attached to a cane and a cane user's wrist.

There is shown in FIG. 1 multi-looped cane retaining strap 10 attached to a user's wrist 12 and a cane 14. The multi-looped cane retaining strap 10 includes a wrist portion 16 and a flexible cord 18 attached by means of a swivel 20.

Figure 2:
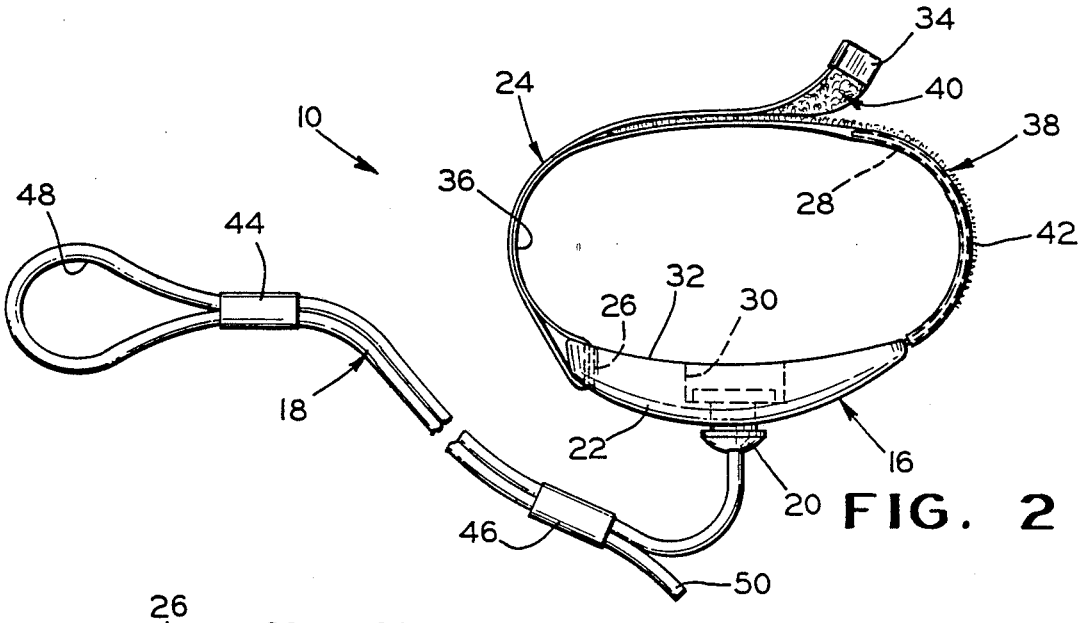
FIG. 2 is a fragmented plan view of the present invention shown in FIG. 1.
Figure 3:
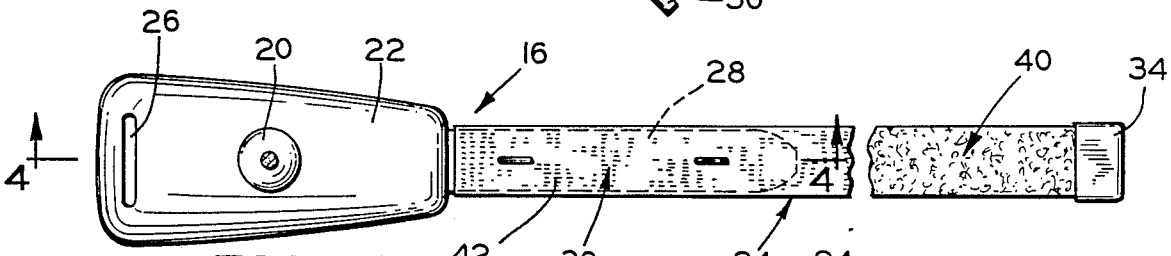
FIG. 3 is a fragmented front elevation view of the wrist strap of the present invention shown in FIG. 1.

The wrist portion 16 of the multi-looped cane retaining strap 10 includes an elongated body portion 22 attached end-to-end to a soft flexible strip of material 24 by gluing, sewing or other suitable means. The body portion 22 is configured at one end with a transverse slot 26 through which the soft flexible strip of material 24 can be inserted forming a loop therein. The body portion 22 is configured at the other end with a longitudinally extending stiffening member 28 over which the flexible strip of material 24 is attached. The body portion 22 is further configured with a generally circular cavity 30 formed in its rear face 32 in which the swivel 20 is attached. The cavity 30 allows the swivel 20 to turn freely within the body portion 22 without contacting the user's wrist. The body portion 20 is typically molded from a plastic material and extends longitudinally from side to side of the user's wrist. The rear face 32 is formed with a generally concave curve from end to end as shown in FIG. 2 to conform to the user's wrist.

The soft flexible strip of material 24 is provided with a stiff nose means 34 which is crimped on the end opposite that which attaches to the stiffening member 28 of the body portion 22. The soft flexible strip of material 24, made of nylon, cotton or polyester for example, is provided with a Velcro fastener, wherein two cooperating members are coupled together so as to allow for a releasable adjustment of the cane retaining strap 10 around the wrist of the user. The user attaches the wrist portion 16 to his wrist by inserting the strip of flexible material 24 through the transverse slot 26 in the body portion 22 thereby creating a loop 36. The loop 36 is held constant in size by engaging the two cooperating members of the Velcro fastener.

The two cooperating members of the Velcro fastener are comprised of a male hook member 38 and a female loop member 40. The hook member 38 has a fabric base having outwardly projecting therefrom a multiplicity of flexible, resilient, plastic hook filaments 42. Each of the filaments 42 forms a hook-like finger which is adapted to engage a large number of small closed-loop, fibers which comprise the female receiving member 38. The above materials are shown in U.S. Pat. Nos. 2,717,437 and 3,009,235.

Figure 4:
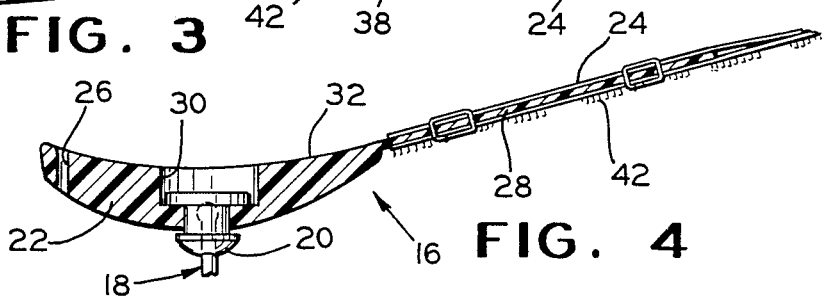
FIG. 4 is a partial sectional view of the present invention taken along line 4—4 in FIG. 3

The swivel 20 is molded into the cavity 30 in the rear face 32 of the body portion 22 of the cane retaining strap 10. The swivel 20 can be made of plastic, metal or other suitable material, and is configured so as to be attached to one end of the flexible cord 18. In the preferred embodiment, the swivel 20 is attached to one end of the cord 18 by means of molding the swivel 20 from a plastic material around the cord 18, so as to create an assembly as shown in FIG. 4. The swivel 20 is configured so as to be free to turn inside the cavity 30 of the body portion 22 of the cane retaining strap 10 in order to prevent twisting of the flexible cord 18 when attached to the cane 14.

The flexible cord 18, made of cotton or nylon for example, is configured on the end opposite from the swivel 20 with a pair of fasteners 44 and 46. The pair of fasteners 44 and 46, attached to the cord 18 by means of crimping, determine the length of the cord 18 and also form a loop 48 therein for adjusting the tightness of the cord 18 around the cane 14. First, a free end 50 of the cord 18 is doubled back toward the swivel 20 and fixed in place with the fastener 46. The size of the loop 48 is determined and fixed with the fastener 44. However, the fasteners are crimped only tightly enough to offer sliding resistance to the cord. The length and tightness of the cord 18 can be adjusted by sliding the cord 18 through the fasteners 44 and 46 until the proper adjustments for length and tightness around the cane are achieved. The nose means 34 and the fasteners 44 and 46 can be formed of a metal material.

During use of the present invention, the cane user attaches the wrist portion 16 around the wrist 12 of the arm which uses the cane 14 by inserting the strip of flexible material 24 through the transverse slot 26 in the body portion 22 forming the loop 36 around his wrist as shown in FIG. 1. The loop 36 is then adjusted around the user's wrist 12 by applying tension to the strip of flexible material 24 until the loop 36 is sufficiently tight around the wrist 12. The tightness of the loop 36 around the wrist 12 is then secured and maintained by the two cooperating members 38 and 40 of the Velcro fastener.

The cane user attaches the loop 48 in the flexible cord 18 around the cane 14 and adjusts the tightness around the cane 14 by sliding the flexible cord 18 through the fastener 44. The length of the cord 18 can be adjusted by sliding the flexible cord through the fasteners 44 and 46.

The cane 14 is now secured to the wrist 12 of the user as shown in FIG. 1 by the present invention. It is obvious that the present invention provides close proximity of the cane 14 to the user and precludes the possibility of disassociation of the cane from the user. The close proximity of the cane 14 to the user and the inability of disassociation allow the cane user to perform everyday tasks without having to lay the cane down, or lean it against something. Furthermore, the user can remove the loop 36 from his wrist and form it around a chair arm, for example, while the user is sitting in the chair thereby maintaining the cane within reach.

Although shown for use with a cane, the present invention can be utilized with any similar object such as an umbrella or a crutch. Furthermore, the materials, textures, and colors of the present invention can be varied to suit the user and the particular use.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A multi-looped cane retaining strap for releasable connection at one end to a cane, and at the opposite end to a wrist of a cane user, said strap comprising:
   - a molded plastic elongated body having a curved rear face adapted to conform to and extend longitudinally from side to side of a user's wrist;
   - a longitudinally extending stiffening member formed at one end of said body, and a transverse slot formed in an opposite end of said body;
   - a flexible strip of material having one end enclosing and attached to said stiffening member at said one end of said body;
   - a nose means attached to an opposite end of said strip;
   - a releasable fastening means attached to said strip for maintaining said flexible strip of material in a loop;
   - a flexible cord;
   - a pair of spaced apart fasteners slidably attached to said cord, said cord being doubled back on itself to form a loop therein, one of said fasteners selectively determining a length of said cord and the other of said fasteners selectively determining a size of said loop; and
   - swivel means rotatably attached to said body and attached to an end of said cord opposite said loop in said cord.

2. A multi-looped cane retaining strap according to claim 1 wherein said body portion is formed of a plastic material.

3. A multi-looped cane retaining strap according to claim 1 wherein said flexible strip of material is formed of nylon material.

4. A multi-looped cane retaining strap according to claim 1 wherein said flexible strip of material is formed of cotton material.

5. A multi-looped cane retaining strap according to claim 1 wherein said flexible strip of material is formed of polyester material.

6. A multi-looped cane retaining strap according to claim 1 wherein said releasable fastening means is a Velcro type fastener.

7. A multi-looped cane retaining strap according to claim 1 wherein said means for attaching is molded from a plastic material.

8. A multi-looped cane retaining strap according to claim 1 wherein said means for attaching is formed from a metal material.

9. A multi-looped cane retaining strap for releasable connection at one end to a cane, and at the opposite end to a wrist of a cane user, said strap comprising:

a wrist portion including a molded plastic elongated body adapted to extend longitudinally from side to side of a user's wrist and having a longitudinally extending stiffening member formed at one end thereof, a flexible strip of material having one end enclosing and attached to said stiffening member at said one end of said body, a transverse slot formed in an opposite end of said body, a nose means attached to an opposite end of said strip, and releasable fastening means attached to said strip for maintaining said flexible strip of material in a loop;

a flexible cord;

a pair of spaced apart fasteners slidably attached to said cord to form a loop therein; and swivel means rotatably attached to said body and attached to an end of said cord opposite said loop in said cord whereby said cord is selectively adjustable in length by movement of one of said fasteners along said cord and said loop in said cord is selectively adjustable in size by movement of the other one of said fasteners along said cord.

10. The strap according to claim 9 wherein said releasable fastening means is a Velcro type fastener material.

11. The strap according to claim 9 wherein said swivel means is molded around said end of said cord opposite said loop in said cord.

* * * * *